US007484845B2

(12) United States Patent
Douglas

(10) Patent No.: US 7,484,845 B2
(45) Date of Patent: Feb. 3, 2009

(54) HEADWEAR WITH KEEPERS FOR EYEGLASSES

(76) Inventor: Calvin Douglas, P.O. Box 859, Fair Oaks, CA (US) 95628

( * ) Notice: Subject to any disclaimer, the term of this patent is extended or adjusted under 35 U.S.C. 154(b) by 0 days.

(21) Appl. No.: 11/489,425

(22) Filed: Jul. 18, 2006

(65) Prior Publication Data

US 2007/0101480 A1 May 10, 2007

Related U.S. Application Data

(60) Provisional application No. 60/736,136, filed on Nov. 9, 2005.

(51) Int. Cl.
*G02C 3/00* (2006.01)

(52) U.S. Cl. ..... 351/155; 2/209.13

(58) Field of Classification Search ..... 351/155, 351/158, 41, 156, 157, 153, 111; 2/10, 209.13, 2/195.1, 452, 12, 209, 13; 24/3.3; D16/102, D16/103, 107, 112, 116

See application file for complete search history.

(56) References Cited

U.S. PATENT DOCUMENTS

| | | | | |
|---|---|---|---|---|
| 4,179,753 | A * | 12/1979 | Aronberg et al. | 2/10 |
| 4,781,451 | A * | 11/1988 | McAllen | 351/156 |
| 4,852,189 | A * | 8/1989 | Duggan | 2/452 |
| 5,309,577 | A * | 5/1994 | Buononato et al. | 2/452 |
| 6,647,554 | B1 * | 11/2003 | Yan | 2/209.13 |
| 7,275,270 | B2 * | 10/2007 | Cotutsca | 2/209.13 |

* cited by examiner

*Primary Examiner*—Hung X Dang
(74) *Attorney, Agent, or Firm*—Dergosits & Noah LLP

(57) ABSTRACT

An inventive headwear for securely placing eyeglasses is disclosed. The headwear can be, for example, a modified baseball cap having elastic keepers located upon the sides of the crown portion of the cap. The temples of a pair of eyeglasses are inserted into the keepers, the keepers exerting a downward pressure upon the temples to keep the eyeglasses securely positioned upon the visor of the headwear.

7 Claims, 4 Drawing Sheets

HEADWEAR WITH KEEPERS FOR EYEGLASSES

RELATED APPLICATIONS

The present application relies upon and seeks the benefit of U.S. Provisional Patent Application No. 60/736,136 filed on Nov. 9, 2005.

TECHNICAL FIELD

The present invention relates to headwear such as baseball caps and brimmed hats, and more specifically to headwear having a means for retaining a pair of eyeglasses thereon.

BACKGROUND OF THE INVENTION

Sunglasses conveniently keep sun glare out of a wearer's eyes and improve a wearer's visibility for such tasks as driving and playing sports. However, when a wearer enters a dimly lit building, or when nightfall arrives, the wearer must search for a place to put his sunglasses. It is also common for a wearer to take his sunglasses off during an activity, set them down on a convenient nearby surface, and forget about them later on. This forgetful habit leads to millions of sunglasses being lost annually and also necessitates that the absent-minded wearers continually purchase new sunglasses. This cycle of losing sunglasses and having to purchase new ones can become expensive, as many quality brands of sunglasses cost over one hundred dollars.

One solution to this problem is for the wearer to place his sunglasses into a pants or shirt pocket until they are needed again, but pocket articles such as keys, or even the coarse fabric of many pants pockets can lead to scratching of sunglass lenses.

Another solution is represented by inventions which place a pair of keepers for retaining a pair of sunglasses upon a headwear article, such as a baseball cap, for example. This arrangement is represented in U.S. Pat. No. 6,237,159 (Martin); U.S. Pat. No. 6,647,554 (Yan) and U.S. Des. Pat. No. D503,261 (Pedersen). The solution of placing sunglasses on a hat in this manner serves the dual purpose of keeping a pair of sunglasses in the possession of the wearer, while keeping the lenses safe from damage. However, the embodiments of this concept represented in the cited patents tend to retain a pair of sunglasses too loosely, thereby causing the sunglasses to often fall from the hat, when the hat is removed quickly from the head, for example. If the sunglasses fall to the ground, their lenses can be damaged by the hard ground surface, or the wearer can destroy the sunglasses to stepping on them.

Therefore, a need exists for an improved headwear having a sunglass keeper which snugly retains a pair of sunglasses or eyeglasses upon the headwear under any normal wearing condition.

The foregoing reflects the state of the art of which the inventor is aware, and is tendered with a view toward discharging the inventor's acknowledged duty of candor, which may be pertinent to the patentability of the present invention. It is respectfully stipulated, however, that the foregoing discussion does not teach or render obvious, singly or when considered in combination, the inventor's claimed invention.

SUMMARY OF THE INVENTION

The inventive device is an improved headwear with a keeper for retaining eyeglasses thereon. In most instances the device will be used with sunglasses to keep them from becoming misplaced. The invention positions the keeper at a location upon the opposite sides of a crown of the headwear, such that when the temples of a pair of sunglasses are inserted into the keepers, a downward pressure is exerted upon the temples, which brings the lens frames into firm contact with the visor or brim portion of the headwear. This action tends to maintain the eyeglasses upon the headwear in a tighter, more positive fashion than the prior art inventions mentioned herein.

BRIEF DESCRIPTION OF THE FIGURES

The invention will be more fully understood by reference to the following drawings which are for illustrative purposes only.

DETAILED DESCRIPTION OF THE INVENTION

Figure 1A:
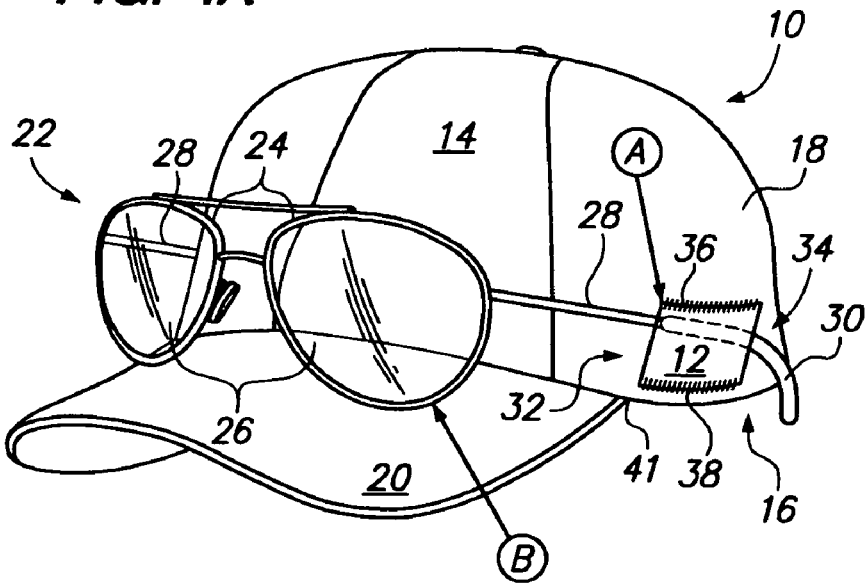
FIG. 1A is an elevated perspective view of the inventive headwear shown with a pair of eyeglasses fully seated thereon.
Figure 1B:
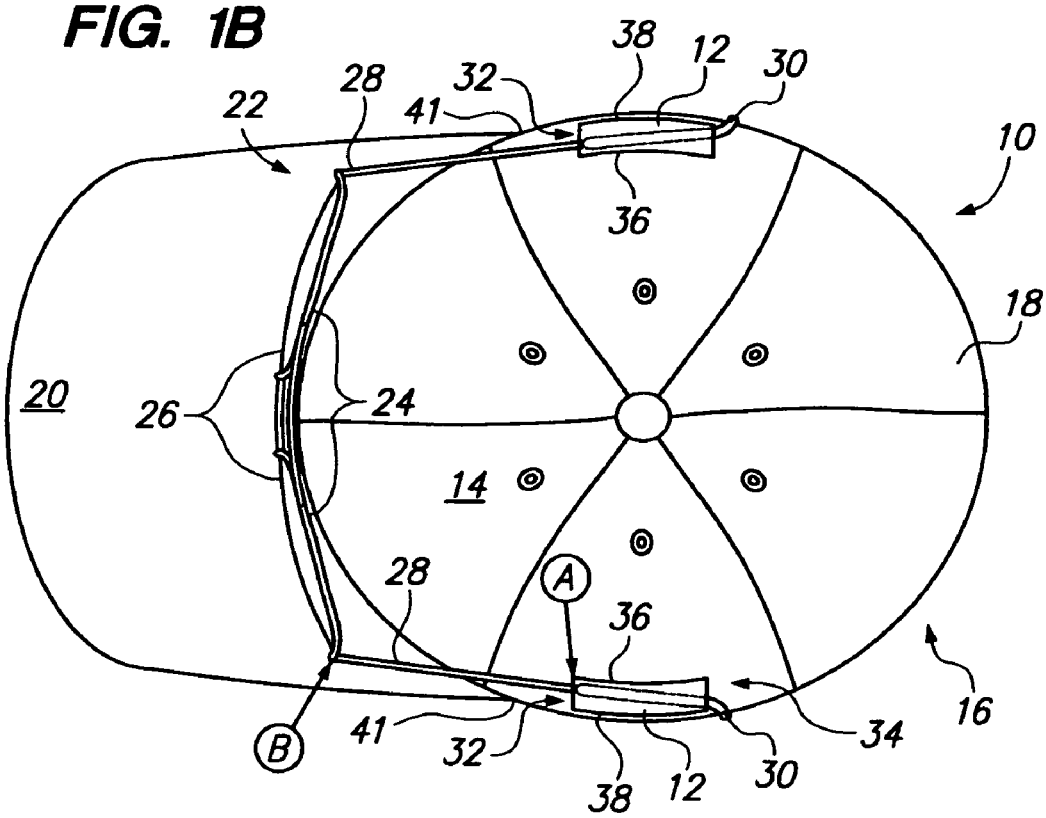
FIG. 1B is a plan view of the inventive headwear shown with a pair of eyeglasses fully seated thereon.

The inventive headwear 10 with eyeglasses keeper 12 is shown in FIGS. 1A and 1B, these figure[s] showing the invention as a baseball cap embodiment. Here the headwear has a crown portion 14 having an interior 16 for fittingly enclosing a human head and an exterior 18 upon which are attached the eyeglasses keepers 12. A visor 20 is attached to the front of the crown in typical baseball cap fashion. The eyeglasses keepers 12 are mounted in aligned pairs located on the left and right sides of the crown 14. The eyeglasses keeper 12 retains eyeglasses 22 having eyeglass frames 24 containing lenses 26 the frames 24 being hinged to a pair of temples 28, the temples 28 extending rearward of the frames and terminating in an end piece 30, the end piece 30 being curved or straight.

Figure 2:
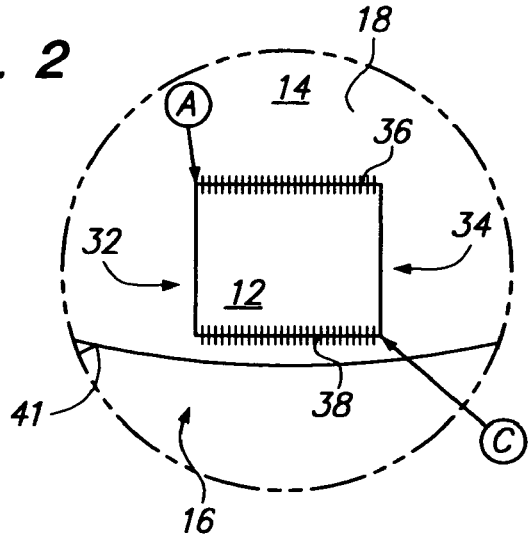
FIG. 2 is a close-up view of the eyeglass keeper attached to the crown portion of the inventive headwear.
Figure 3:
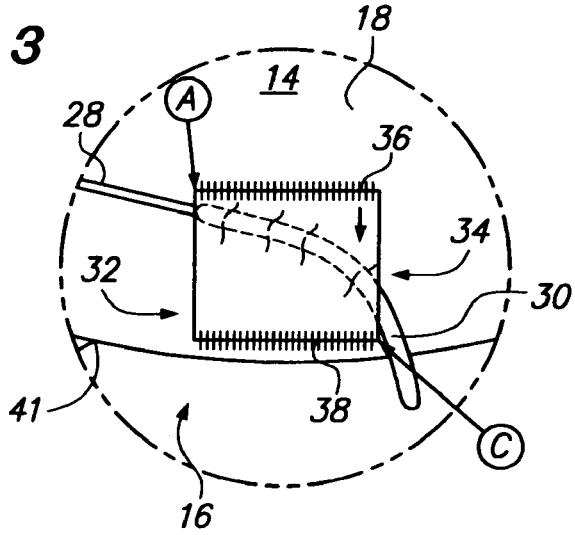
FIG. 3 is a close-up view of the eyeglass keeper shown with a temple portion of a pair of eyeglasses positioned within the keeper.

FIG. 2 is a close-up view of the preferred eyeglasses keeper 12. The keeper 12 is a square, rectangular or trapezoidal patch with four corners. The keeper 12 has a front opening 32 and a rear opening 34, the keeper 12 further being fastened to the cap 10 across its top 36 and bottom 38 edges. The top and bottom edges 36, 38 are typically stitched to the cap 10, but other means of fastening, including pins, staples, rivets or adhesive could also be used. The distance between top and bottom edges 36, 38 on the interior side of the keeper 12 which contacts the temples 28 of a pair of eyeglasses 22 is between 1" and 1⅛". The front and rear openings, 32, 34 receive the end pieces 30 and temples 28 of a pair of eyeglasses 22, as shown in FIG. 3. The keeper 12 is made of heavy duty elastic materials, such as Stretchrite™, which is manufactured by Rhode Island Textile Company of Pawtucket, R.I. This material has proven to have strong wear characteristics and elastic properties required by the invention.

Figure 5:
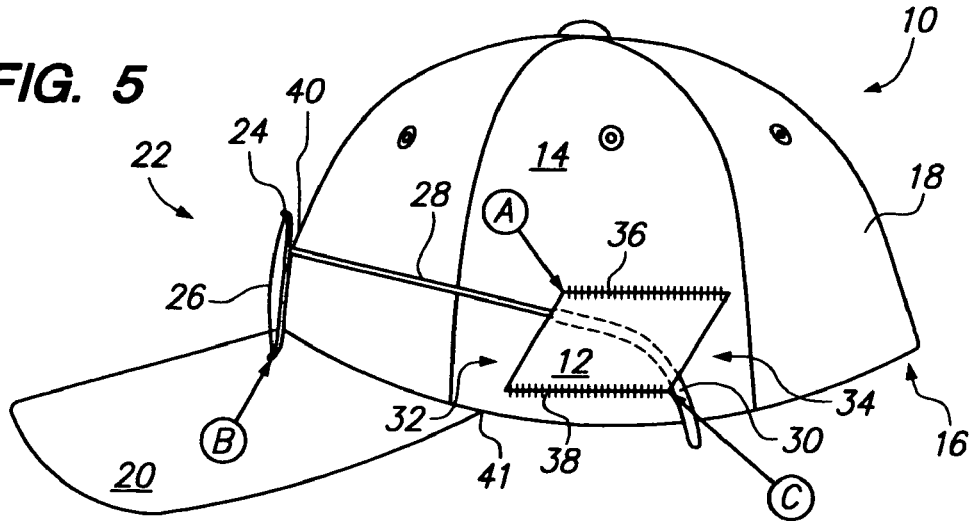
FIG. 5 is a side view of an alternative embodiment of the baseball cap of the present invention.
Figure 4A:
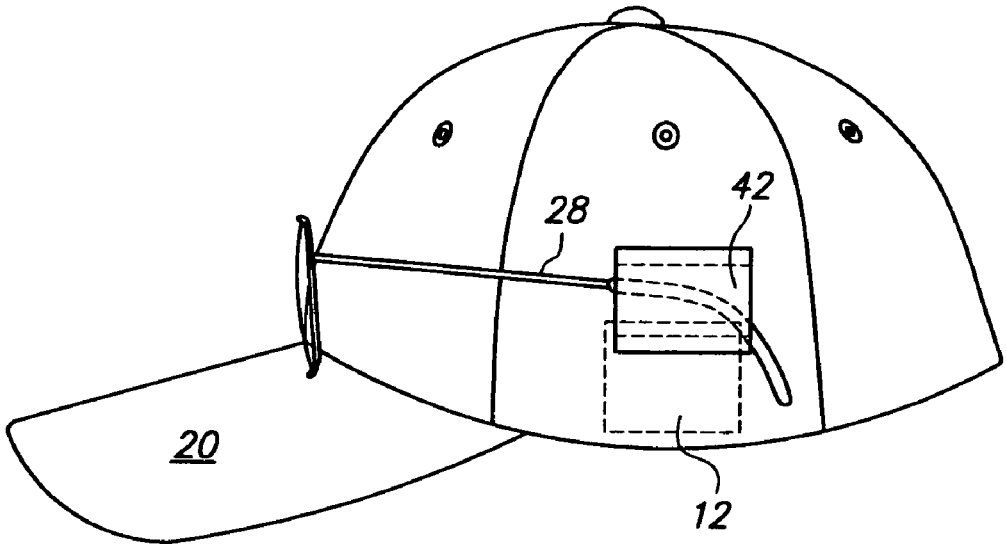
FIG. 4A (Prior Art)
FIG. 4A is a side view of a prior art baseball cap having an eyeglass keeper, shown with a pair of eyeglasses positioned thereon.
Figure 4B:
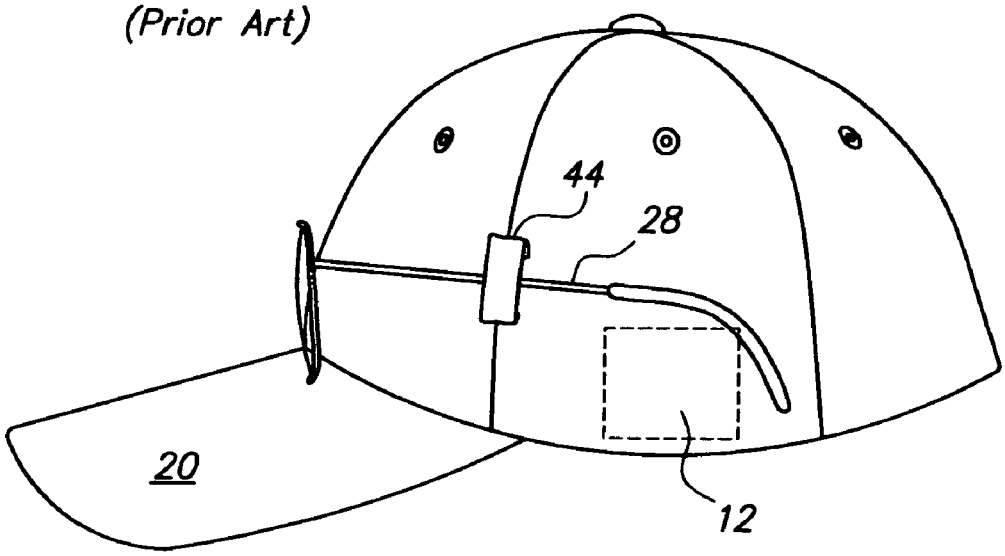
FIG. 4B (Prior Art)
FIG. 4B is a side view of a prior art baseball cap having an eyeglass keeper, shown with a pair of eyeglasses positioned thereon.
Figure 4C:
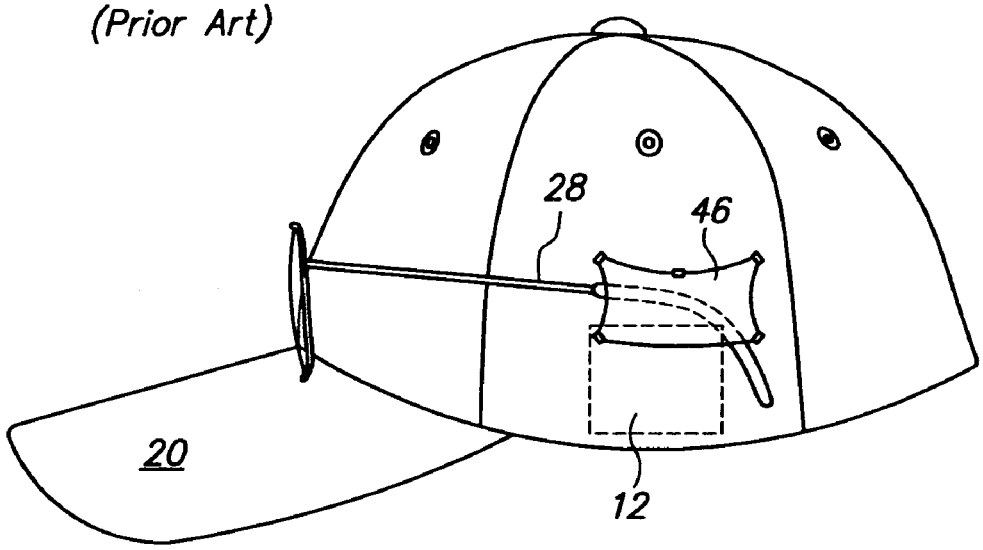
FIG. 4C (Prior Art)
FIG. 4C is a side view of a prior art baseball cap having an eyeglass keeper, shown with a pair of eyeglasses positioned thereon.
Figure 4D:
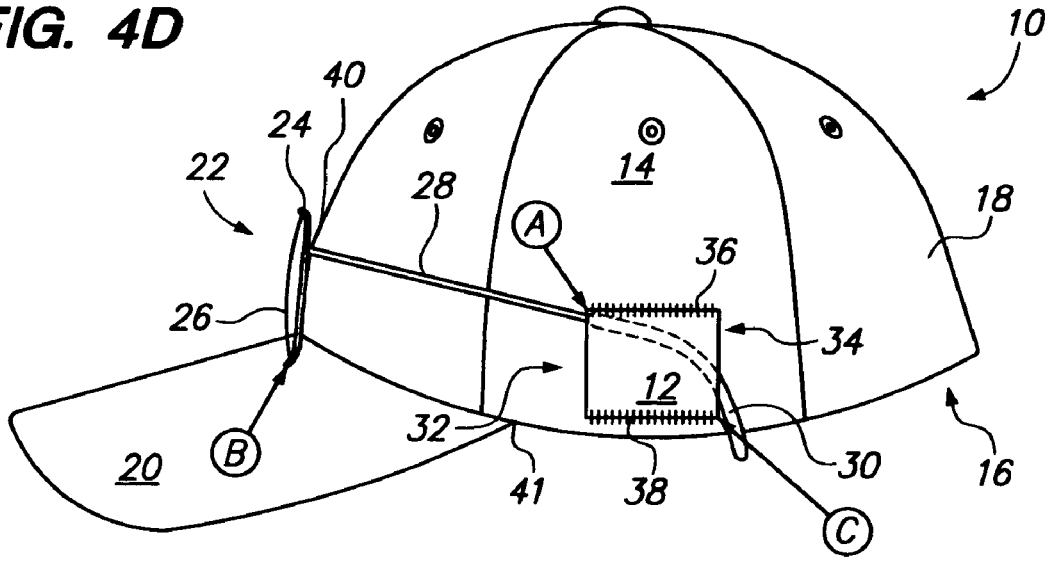
FIG. 4D is a side view of a baseball cap of the present invention shown with a pair of eyeglasses positioned thereon for comparison with the prior art baseball caps shown in FIGS. 4A-4C.

Upon inserting the end pieces 30 and temples 28 of a pair of eyeglasses 22 through front opening 32, the eyeglasses 22 are preferably pushed rearward until the inside of the eyeglass frames 24 contact the front 40 of the crown portion 14 of the cap 10 (see FIGS. 4D and 5). At this point, the eyeglasses 22 are fully seated in the keepers 12. The end pieces 30 of a standard set of eyeglasses 22 will protrude through the rear opening 34. Once seated, the keepers 12 exert downward pressure upon the top of the temples at keeper corner (point "A"). This downward pressure keeps the bottom (point "B") of eyeglass frames 24 pressed against the visor 20. When properly seated, the temples 28 are downwardly angled due to the downward pressure applied by keepers 12 upon the temples 28, this downward pressure positioning the end pieces 30 lower than the bottom (point "B") of the frames 24 resting on the visor 20. The end pieces 30, especially curved end pieces, are held fast at keeper corner (point "C"), thereby providing another point of firm engagement of the eyeglasses 22 upon the headwear 10.

The placement of the keepers 12 upon the sides of the crown 14 of cap 10 is crucial to maintaining corner point "A" or keeper 12 at the proper location for exerting downward pressure upon temples 28. The placement of the keepers 12 differentiates the inventive headwear 10 from the prior art. Referring to FIGS. 4A-4C, the keepers 42, 44, 46, shown at locations upon the crown 14 represent typical placement of prior art keepers having eyeglasses inserted therein. Also shown in phantom in FIGS. 4A-4C is the placement location of the keeper 12 of the present invention along with a phantom cutaway portion of a temple 28 of a pair of eyeglasses, for comparison with the prior art. FIG. 4D shows the preferred embodiment of the invention with the keeper 12 shown placed low on the crown 14, adjacent to the junction 41, where the visor 20 meets the crown 14. This lower placement of the keepers 12, when compared to the prior art, draws the temples 28 downward, which also draws the lens frames 24 downward against the visor 20. The elastic keepers at corner point "A" stretch around the temples 28, thereby creating a first frictional engagement with the eyeglasses. A second frictional engagement is created when the bottom of the frames at point "B" are pressed against the visor 20. The elastic keepers stretch around the temples, serving to contact a larger surface area than the prior art keepers.

FIG. 5 shows the keeper 12 having a trapezoidal shape. The front angles side 42 of the keeper 12 is raked at preferably about a 60 degree angle. The inventor feels that this embodiment facilitates the guiding of the end portions 30 of the temples 28 into the front opening 32 of the keeper 12.

The inventive headwear as described herein maintains a pair of eyeglasses more firmly upon the headwear than the prior art. Once a pair of eyeglasses is inserted into the keepers of the invention, even fairly vigorous movements fail to dislodge the eyeglasses from the inventive headwear. The inventive headwear presents a safe and secure location for eyeglasses to be placed so that they will not be lost or damaged during normal daily activities.

Finally, although the description above contains many specificities, these should not be construed as limiting the scope of the invention but as merely providing illustrations of some of the presently preferred embodiments of this invention. This invention may be altered and rearranged in numerous ways by one skilled in the art without departing from the coverage of any patent claims which are supported by this specification.

The invention claimed is:

1. In headwear comprising a hat or cap having a crown for residing upon and covering a substantial portion of the user's head and a brim connected to said crown for extending forward and above a user's face when worn, the improvement comprising a pair of keepers, each keeper being located on opposite sides of said crown, said keepers being sized and positioned to releaseably retain temples of a pair of glasses whereupon lens frames of the glasses are urged onto pressure contact with said brim thus resisting inadvertent removal of said temples from said keepers.

2. The headwear of claim 1 wherein said keepers comprise a pair of square, rectangular or trapezoidal patches having four corners.

3. The headwear of claim 2 wherein said keepers are characterized as having front and rear and top and bottom edges, said front and rear edges being open and said top and bottom edges being fastened to said crown.

4. The headwear of claim 3 wherein said top and bottom edges are stitched to said crown.

5. The headwear of claim 2 wherein said keepers are trapezoidal, the front and back edges of which are joined to its top and bottom edges at an angle of approximately 60 degrees.

6. The headwear of claim 1 wherein said keepers comprise elasticized fabric.

7. The headwear of claim 1 wherein said keepers are sized and positioned on said crown such that when said glasses are releaseably retained thereby, said temples angle downwardly from said brim to said keepers.

* * * * *